US007523509B1

(12) United States Patent
Willard

(10) Patent No.: US 7,523,509 B1
(45) Date of Patent: Apr. 28, 2009

(54) COMBINED AUXILIARY TOILET SEAT AND ASSOCIATED CARRYING BAG

(76) Inventor: Robin Willard, 3277 NW. 114th Ter., Coral Springs, FL (US) 33065

( * ) Notice: Subject to any disclaimer, the term of this patent is extended or adjusted under 35 U.S.C. 154(b) by 364 days.

(21) Appl. No.: 11/517,050

(22) Filed: Sep. 7, 2006

(51) Int. Cl.
*A47K 13/14* (2006.01)

(52) U.S. Cl. ..... 4/239; 4/245.2

(58) Field of Classification Search ..... 4/239, 4/245.2
See application file for complete search history.

(56) References Cited

U.S. PATENT DOCUMENTS 4,525,880 A 7/1985 Bass
D314,424 S 2/1991 Davenport et al.
4,998,297 A 3/1991 Summerville
5,090,063 A * 2/1992 Edwards et al. ..... 4/239
5,267,355 A 12/1993 Landman
5,729,838 A 3/1998 Schweizer
6,000,068 A * 12/1999 Chavis ..... 4/244.3
6,175,968 B1 1/2001 Schneider

* cited by examiner

*Primary Examiner*—Charles E Phillips

(57) ABSTRACT

A combined portable toilet seat and carrying bag includes a foldable toilet seat that has first and second coextensively shaped sections pivotally connected to each other. Each section has an arcuate shape provided with offset proximal and distal ends. The sections form a U-shape when adapted to the unfolded position. The sections are hingedly coupled at their proximal ends. A mechanism is included for storing a predetermined quantity of sanitary sheaths in such a manner that the user can quickly extract one of the sheaths and pull the sheath across entire surface areas of the first and second sections when the toilet seat is biased to an unfolded position. The sanitary sheath storing mechanism is permanently secured to one section. A carrying bag has a handle and a zipper attached thereto for securely receiving and transporting the toilet seat.

18 Claims, 4 Drawing Sheets

COMBINED AUXILIARY TOILET SEAT AND ASSOCIATED CARRYING BAG

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to auxiliary toilet seats and, more particularly, to a combined auxiliary toilet seat and associated carrying bag for providing a sanitary barrier between a public restroom user and a public restroom toilet seat.

2. Prior Art

A traveler, as well as others, often encounters unpleasant situations whereby it is absolutely essential to utilize an establishment's toilet facilities or restrooms and the facilities are otherwise than sanitary. To be sure, such experiences are distasteful notwithstanding the possible hazards involved concerning the transmission of communicable diseases. Blind persons and elderly persons and person of the like are especially adversely affected by such situations because of their inherent inability to be able to even see if a facility is unsanitary let alone to be able to attempt to sanitize such a facility or to prevent from being contaminated by personal contact.

Children are also at an increased risk when using public restroom facilities, seeing that they might not even be aware of the need to properly sanitize a toilet seat prior to use. Indeed, even a facility which appears to be sanitary, is not necessarily so. Immediate prior use may render unsanitary, an otherwise sanitary facility. Consequently, the use of any toilet facility away from home is attendant with unavoidable risks.

One widely used prior art attempt to overcome the above-identified problem is the use of paper toilet seat covers which are most often provided in airplanes and other high-class establishments. Typically, such paper covers are available from dispensing apparatus within close proximity of the facility to be used. One paper cover is pulled from the dispenser and applied over the permanent toilet seat. Such covers, however, do not completely solve the above-stated problem. The paper covers do not usually stay in place, and they often stick to a person's skin and do not conveniently allow for adjustment of positioning. Consequently, a person often chooses not to utilize the cover especially where the facility "appears" to be sanitary. And, when used, a certain amount of inconvenience and discomfort is still present. In addition, conventional paper covers allow urine to leak therethrough.

All of the prior art portable and foldable toilet seats known to the present inventor suffer from similar deficiencies despite their claimed advantages. Any contamination, dirt, disease, etc., present on the permanent seat is or may be transferred to the underside of the portable toilet seat which then would necessarily contaminate the portable seat. No solution is offered for the removal of such dirt or contamination. In most of the cited examples, the bottom surfaces of the portable seat fold flat against each other so that such contamination is not transferred to the top surface of the seat. Still, it is not desirable for such contamination to be present because of the nature of the same and the very real probability of a person touching the underside surface of the seat or some other object, such as the container for the seat, becoming contaminated, and such other object being touched by the individual thereby indirectly transferring the contamination to an individual.

Accordingly, a need remains for a combined auxiliary toilet seat and associated carrying bag in order to overcome the above-noted shortcomings. The present invention satisfies such a need by providing an auxiliary toilet seat that is convenient and easy to use, is practical in design, and greatly increases a user's safety and sanitation. Such a compact and foldable auxiliary toilet seat can conveniently be taken wherever a person goes, to ensure that their toilet usage regiment is not interrupted because of a lack of facilities suitable for use by the child or adult. The cushioned seat effectively covers a standard toilet seat, making it safer and more sanitary for the child to use. The disposable plastic sheaths provided with the auxiliary seat advantageously provide an extra level of protection to the user, while also making it easier for a user to clean/sanitize the seat after every use. When not in, such an auxiliary toilet seat can conveniently be compactly folded and fit discreetly into it associated carrying bag.

BRIEF SUMMARY OF THE INVENTION

In view of the foregoing background, it is therefore an object of the present invention to provide a combined auxiliary toilet seat and associated carrying bag. These and other objects, features, and advantages of the invention are provided by a combined portable toilet seat and carrying bag for advantageously providing a sanitary barrier between the user and a public restroom toilet seat.

The combined portable training seat and carrying bag includes a foldable-seat that has first and second coextensively shaped sections pivotally connected to each other. Each of the first and second sections has arcuate shapes provided with axially offset proximal and distal ends respectively. Such first and second sections form a U-shape when adapted to the unfolded position. The first and second sections are hingedly coupled directly at respective ones of the proximal ends such that the first and second sections become horizontally stacked when articulated to a folded position. Such proximal ends of the first and second sections preferably lay contiguously side-by-side when the first and second sections are adapted to the unfolded position. Each of the first and second sections may be provided with a planar top surface that continuously extends along a quadrant such that a semi-circular path is formed when the first and second sections are biased to the unfolded position.

A mechanism is included for storing a predetermined quantity of sanitary sheaths in such a manner that the user can quickly extract one of the sheaths and pull the one sheath across entire surface areas of the first and second sections when the foldable seat is biased to an unfolded position. Such a sanitary sheath storing mechanism is permanently and directly secured to one of the first and second sections. The sanitary sheath storing mechanism preferably includes a housing that is directly coupled to the first section and is spaced from the second section.

The housing has an open face directly mated to the distal end of the first section and further includes a closed face distally spaced therefrom. An exposed sheath may include a pull tab attached thereto and protruding outwardly from the open face of the housing such that the user can conveniently quickly and effectively pull the exposed sheath out from the housing and over the first and second sections of the foldable toilet seat when the first and second sections are adapted to the unfolded position. The exposed sheath covers an entire surface area of the first and second sections.

A carrying bag has a handle and a zipper attached thereto for conveniently and securely receiving and transporting the foldable toilet seat during non-operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
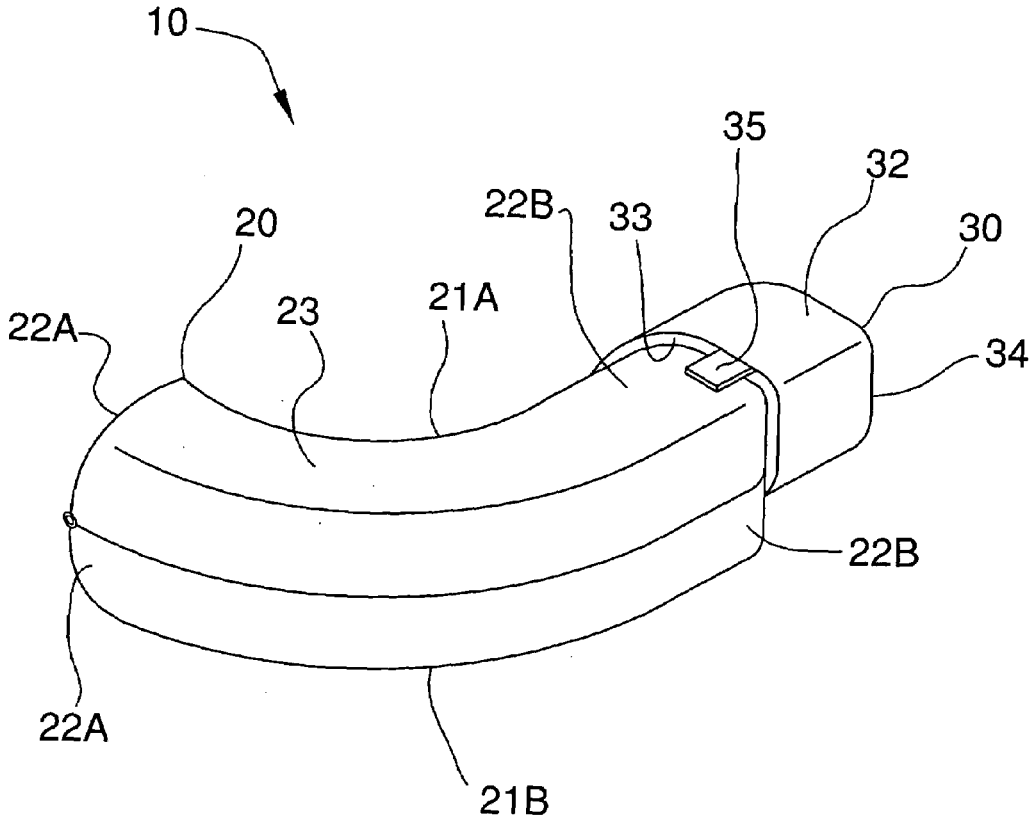
FIG. 1 is a perspective view showing an auxiliary toilet seat at a folded position, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide a combined auxiliary toilet seat and associated carrying bag. It should be understood that the apparatus 10 may be used to cover many different types of toilet seats and should not be limited in use to only covering round/oval toilet seats for children in public restroom facilities.

Figure 2:
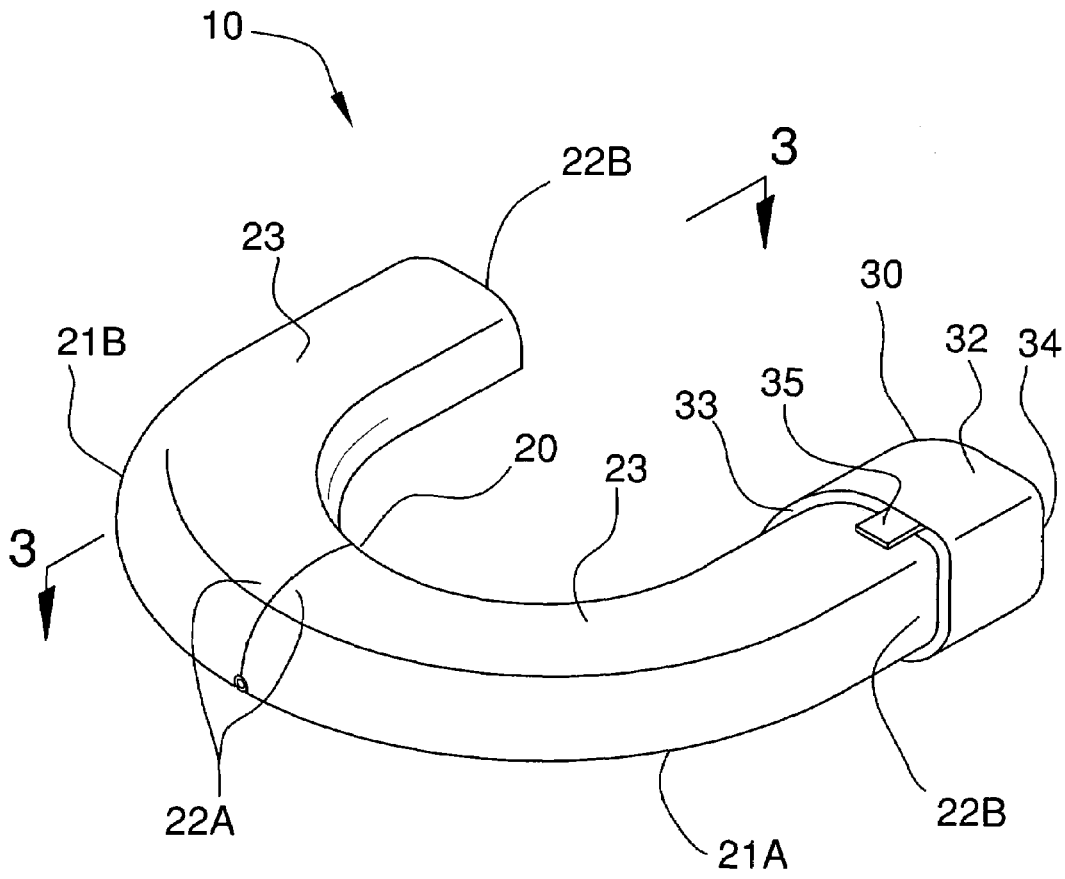
FIG. 2 is a perspective view of the auxiliary toilet seat shown in FIG. 1, showing the first and second sections at an unfolded position.
Figure 3:
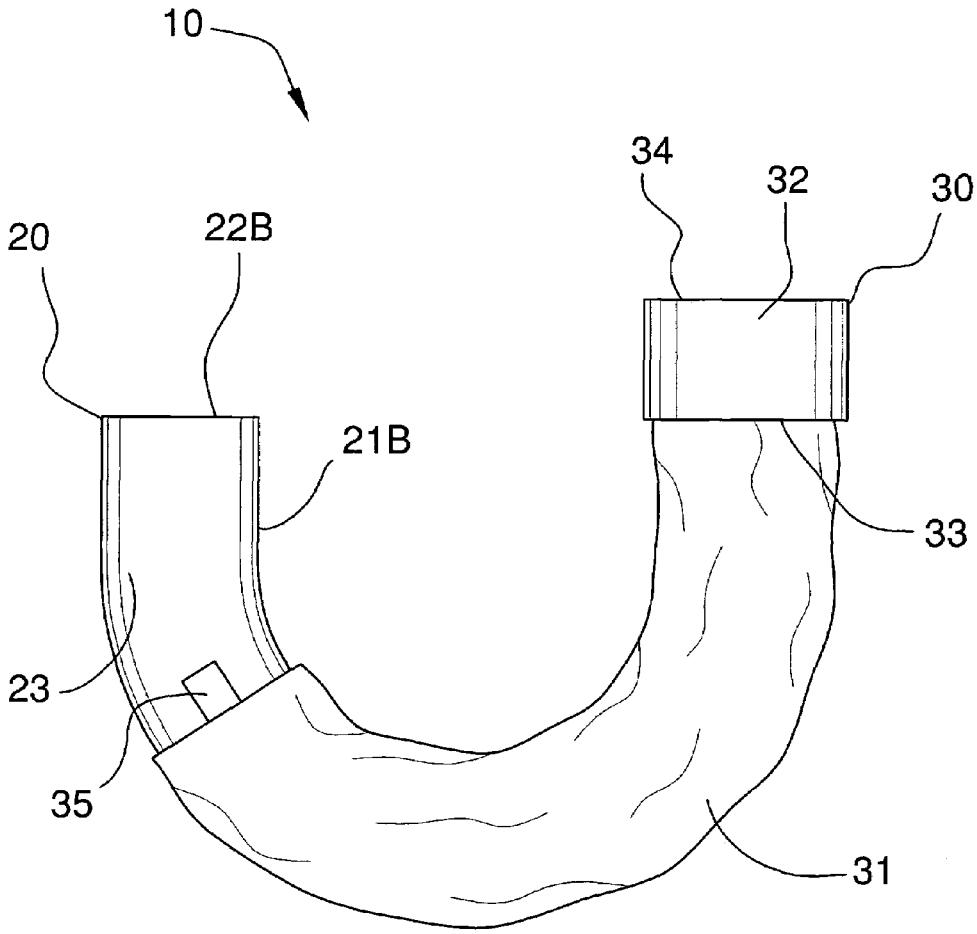
FIG. 3 is a top plan view of the apparatus shown in FIG. 2, showing a disposable sheath partially extended across the surface areas of the auxiliary toilet seat.

Referring initially to FIGS. 1, 2 and 3, the apparatus 10 includes a foldable seat 20 that has first 21A and second 21B coextensively shaped sections pivotally connected to each other. Of course, the first 21A and second 21B sections of the seat 20 may be produced in a variety of alternate sizes for being used by adults as well as children, as is obvious to a person of ordinary skill in the art. Each of the first 21A and second 21B sections has arcuate shapes provided with axially offset proximal 22A and distal 22B ends respectively. Such first 21A and second 21B sections form a U-shape when adapted to the unfolded position, which is essential for allowing the seat 20 to effectively cover an entire surface area of a conventional toilet seat (not shown).

The first 21A and second 21B sections are hingedly coupled directly at respective ones of the proximal ends 22A, which is important such that the first 21A and second 21B sections become horizontally stacked when articulated to a folded position, advantageously allowing the seat 20 to be adapted to a more compact shape for quick and easy storage thereof. Such proximal ends 22A of the first 21A and second 21B sections lay contiguously side-by-side when the first 21A and second 21B sections are adapted to the unfolded position, as is best shown in FIG. 2. Each of the first 21A and second 21B sections is provided with a planar top surface 23 that continuously extends along a quadrant such that a semicircular path is formed when the first 21A and second 21B sections are biased to the unfolded position, as is illustrated in FIG. 2.

Again referring to FIGS. 1, 2 and 3, a mechanism 30 is included for storing a predetermined quantity of sanitary sheaths 31 in such a manner that a user can advantageously quickly extract one of the sheaths 31 and pull the one sheath 31 across entire surface areas of the first 21A and second 21B sections when the foldable toilet seat 20 is biased to an unfolded position. This is a vital and advantageous feature for ensuring that the user is effectively isolated from the conventional toilet seat and the folding seat 20, while also ensuring that the folding seat 20 is isolated from the conventional toilet seat, thus effectively preventing the user from being exposed to bacteria and disease as they manipulate the apparatus 10 after each use. Such a sanitary sheath storing mechanism 30 is permanently and directly secured, without the use of intervening elements, to one of the first 21A and second 21B sections.

The sanitary sheath storing mechanism 30 includes a housing 32 that is directly coupled, without the use of intervening elements, to the first section 21A and is spaced from the second section 21B. The housing 32 has an open face 33 directly mated, without the use of intervening elements, to the distal end 22B of the first section 21A and further includes a closed face 34 distally spaced therefrom.

Referring to FIG. 3, an exposed one of the sheaths 31 includes a pull tab 35 attached thereto and protruding outwardly from the open face 33 of the housing 32, which is important such that the user can conveniently quickly and effectively pull the exposed sheath 31 out from the housing 32 and over the first 21A and second 21B sections of the foldable toilet seat 20 when the first 21A and second 21B sections are adapted to the unfolded position. The exposed sheath covers 31 an entire surface area of the first 21A and second 21B sections, as is best shown in FIG. 3. Following a use of the apparatus 10 the user can advantageously quickly and easily remove the exposed sheath 31 and discard same within a trash receptacle. This feature conveniently greatly reduces the amount of cleaning required in order to maintain the sanitary state of the portable toilet seat 20, this making the apparatus 10 much more appealing than conventional toilet seat covers.

Figure 4:
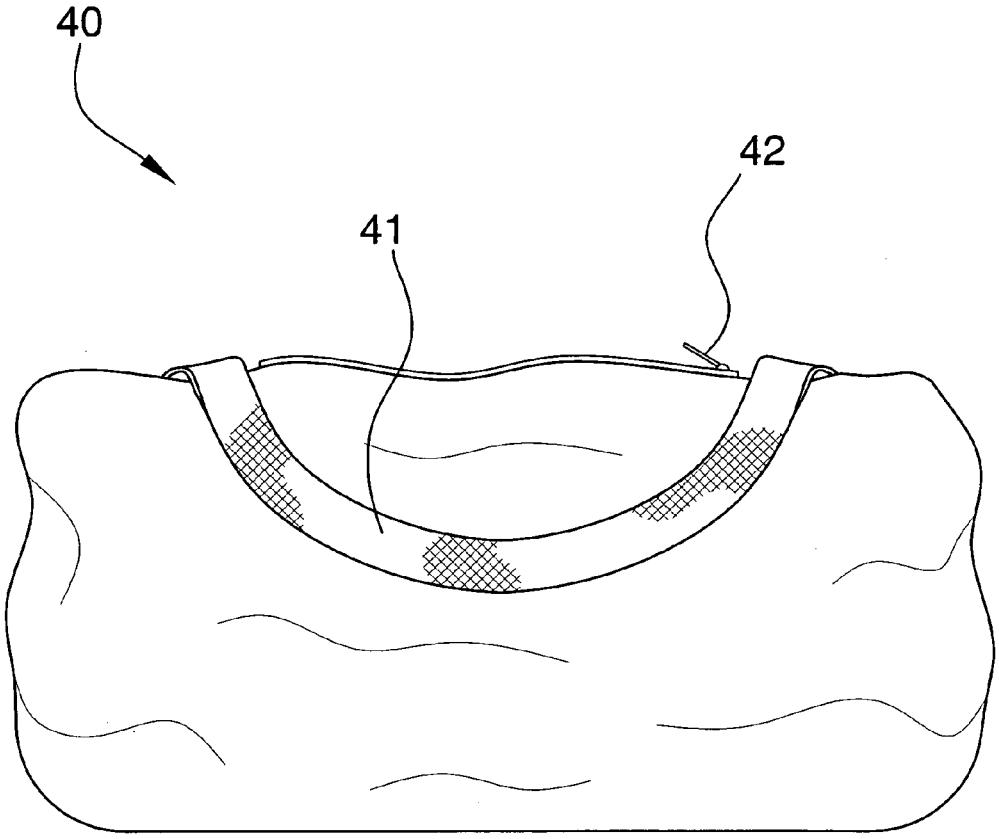
FIG. 4 is a side-elevational view showing a carrying bag, in accordance with the present invention.

Referring to FIG. 4, a carrying bag 40 has a handle 41 and a zipper 42 attached thereto for conveniently and securely receiving and transporting the foldable toilet seat 20 during non-operating conditions. Such a carrying bag 40 is crucial for advantageously and conveniently allowing a user to quickly and easily transport the apparatus 10 between remote locations. Of course, the carrying bag 40 may be produced in a variety of alternate colors and sizes and with logos or surface indicia printed thereon, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable training seat for providing a sanitary barrier between a user child and a public restroom toilet seat, said portable toilet seat comprising:

a foldable toilet seat having first and second coextensively shaped sections pivotally connected to each other, each of said first and second sections having arcuate shapes provided with axially offset proximal and distal ends respectively, said first and second sections being hingedly coupled directly at respective ones of said proximal ends such that said first and second sections become horizontally stacked when articulated to a folded position;

means for storing a predetermined quantity of sanitary sheaths in such a manner that the user can quickly extract one of said sheaths and pull said one sheath across entire surface areas of said first and second sections when said foldable toilet seat is biased to an unfolded position; and wherein said sanitary sheath storing means is permanently and directly secured to one of said first and second sections.

2. The apparatus of claim 1, wherein each of said first and second sections is provided with a planar top surface continuously extending along a quadrant such that a semi-circular path is formed when said first and second sections are biased to the unfolded position.

3. The apparatus of claim 1, wherein said proximal ends of said first and second sections contiguously lay side-by-side when said first and second sections are adapted to the unfolded position.

4. The apparatus of claim 1, wherein said sanitary sheath storing means comprises:

a housing directly coupled to said first section and spaced from said second section, said housing having an open face directly mated to said distal end of said first section and further including a closed face distally spaced therefrom.

5. The apparatus of claim 4, wherein an exposed one of said sheaths comprises:

a pull tab attached thereto and protruding outwardly from said open face of said housing such that the user can quickly and effectively pull said exposed sheath out from said housing and over said first and second sections of said foldable toilet seat when said first and second sections are adapted to the unfolded position.

6. The apparatus of claim 5, wherein said exposed sheath covers an entire surface area of said first and second sections.

7. A portable toilet seat and for providing a sanitary barrier between a user and a public restroom toilet seat, said portable toilet seat comprising:

a foldable toilet seat having first and second coextensively shaped sections pivotally connected to each other, each of said first and second sections having arcuate shapes provided with axially offset proximal and distal ends respectively, wherein said first and second sections form a U-shape when adapted to the unfolded position, said first and second sections being hingedly coupled directly at respective ones of said proximal ends such that said first and second sections become horizontally stacked when articulated to a folded position;

means for storing a predetermined quantity of sanitary sheaths in such a manner that the user can quickly extract one of said sheaths and pull said one sheath across entire surface areas of said first and second sections when said foldable toilet seat is biased to an unfolded position; and wherein said sanitary sheath storing means is permanently and directly secured to one of said first and second sections.

8. The apparatus of claim 7, wherein each of said first and second sections is provided with a planar top surface continuously extending along a quadrant such that a semi-circular path is formed when said first and second sections are biased to the unfolded position.

9. The apparatus of claim 7, wherein said proximal ends of said first and second sections contiguously lay side-by-side when said first and second sections are adapted to the unfolded position.

10. The apparatus of claim 7, wherein said sanitary sheath storing means comprises:

a housing directly coupled to said first section and spaced from said second section, said housing having an open face directly mated to said distal end of said first section and further including a closed face distally spaced therefrom.

11. The apparatus of claim 10, wherein an exposed one of said sheaths comprises:

a pull tab attached thereto and protruding outwardly from said open face of said housing such that the user can quickly and effectively pull said exposed sheath out from said housing and over said first and second sections of said foldable toilet seat when said first and second sections are adapted to the unfolded position.

12. The apparatus of claim 11, wherein said exposed sheath covers an entire surface area of said first and second sections.

13. A combined portable toilet seat and carrying bag for providing a sanitary barrier between a child and a public restroom toilet seat, said combined portable toilet seat and carrying bag comprising:

a foldable toilet seat having first and second coextensively shaped sections pivotally connected to each other, each of said first and second sections having arcuate shapes provided with axially offset proximal and distal ends respectively, wherein said first and second sections form a U-shape when adapted to the unfolded position, said first and second sections being hingedly coupled directly at respective ones of said proximal ends such that said first and second sections become horizontally stacked when articulated to a folded position;

means for storing a predetermined quantity of sanitary sheaths in such a manner that the user can quickly extract one of said sheaths and pull said one sheath across entire surface areas of said first and second sections when said foldable toilet seat is biased to an unfolded position, wherein said sanitary sheath storing means is permanently and directly secured to one of said first and second sections; and a carrying bag having a handle and a zipper attached thereto for securely receiving and transporting said foldable toilet seat during non-operating conditions.

14. The apparatus of claim 13, wherein each of said first and second sections is provided with a planar top surface continuously extending along a quadrant such that a semicircular path is formed when said first and second sections are biased to the unfolded position.

15. The apparatus of claim 13, wherein said proximal ends of said first and second sections contiguously lay side-by-side when said first and second sections are adapted to the unfolded position.

16. The apparatus of claim 13, wherein said sanitary sheath storing means comprises:

a housing directly coupled to said first section and spaced from said second section, said housing having an open face directly mated to said distal end of said first section and further including a closed face distally spaced therefrom.

17. The apparatus of claim 16, wherein an exposed one of said sheaths comprises:

a pull tab attached thereto and protruding outwardly from said open face of said housing such that the user can quickly and effectively pull said exposed sheath out from said housing and over said first and second sections of said foldable toilet seat when said first and second sections are adapted to the unfolded position.

18. The apparatus of claim 17, wherein said exposed sheath covers an entire surface area of said first and second sections.

* * * * *